US010610878B2

(12) United States Patent
Winter et al.

(10) Patent No.: US 10,610,878 B2
(45) Date of Patent: Apr. 7, 2020

(54) ADJUSTABLE SHOWER SYSTEM

(71) Applicant: Nebia Inc., San Francisco, CA (US)

(72) Inventors: Philip Winter, San Francisco, CA (US); Gabriel Parisi-Amon, San Francisco, CA (US); David Shulman, San Francisco, CA (US); Brian Willkom, San Francisco, CA (US); Scott Steber, San Francisco, CA (US); Ace Shelander, San Francisco, CA (US); Yoav Ben-Haim, San Francisco, CA (US)

(73) Assignee: Nebia, Inc., San Francisco, CA (US)

( * ) Notice: Subject to any disclaimer, the term of this patent is extended or adjusted under 35 U.S.C. 154(b) by 116 days.

(21) Appl. No.: 15/673,310

(22) Filed: Aug. 9, 2017

(65) Prior Publication Data

US 2018/0126407 A1 May 10, 2018

Related U.S. Application Data

(60) Provisional application No. 62/373,237, filed on Aug. 10, 2016.

(51) Int. Cl.
*E03C 1/04* (2006.01)
*B05B 15/656* (2018.01)
(Continued)

(52) U.S. Cl.
CPC ..... *B05B 15/656* (2018.02); *E03C 1/0408* (2013.01); *E03C 1/066* (2013.01);
(Continued)

(58) Field of Classification Search
CPC ..... B05B 15/65; B05B 15/652; B05B 15/654; B05B 15/656; B05B 15/658; B05B 1/16;
(Continued)

(56) References Cited

U.S. PATENT DOCUMENTS 4,360,159 A * 11/1982 Haynes ..... E03C 1/066 239/282
6,438,767 B1 * 8/2002 Warshawsky ..... E03C 1/0408 4/567

(Continued)

*Primary Examiner* — Viet Le
*Assistant Examiner* — Juan C Barrera
(74) *Attorney, Agent, or Firm* — Run8 Patent Group, LLC; Peter Miller

(57) ABSTRACT

One variation of a system includes: a pipe adapter defining an inlet configured to thread into a water supply outlet adjacent a shower wall, defining an external threaded section opposite the inlet, and defining an internal bore between the inlet and the external threaded section; a collar defining: a surface configured to face the shower wall; a retention feature offset from the surface; and an internal threaded section defining an axis normal the surface, the internal threaded section configured to mate with the external threaded section of the pipe adapter to position the surface approximately flush with the shower wall; a nipple configured to insert into the pipe adapter and comprising a seal configured to mate with the internal bore; a shower head defining a nozzle fluidly coupled to the nipple; and a latch configured to transiently engage the retention feature to constrain the shower head against the collar.

20 Claims, 11 Drawing Sheets

(51) Int. Cl.
*E03C 1/06* (2006.01)
*B05B 1/18* (2006.01)
*B05B 1/16* (2006.01)

(52) U.S. Cl.
CPC ..... *B05B 1/16* (2013.01); *B05B 1/185* (2013.01); *E03C 2001/0414* (2013.01)

(58) Field of Classification Search
CPC ..... B05B 1/185; E03C 1/066; E03C 1/0408; E03C 2001/0414; E03C 1/06; E03C 1/025; E03C 1/021; E03C 1/0404; E03C 2001/0415; E03C 1/042; F16B 7/1481; F16B 13/0875; F16B 19/109
USPC ..... 239/283; 285/139.3, 143.1, 140.1, 219
See application file for complete search history.

(56) References Cited

U.S. PATENT DOCUMENTS

| | | | | |
|---|---|---|---|---|
| 7,748,649 | B2 * | 7/2010 | Fujii | E03C 1/0408 239/436 |
| 2012/0013081 | A1 * | 1/2012 | Craig | F16B 19/109 279/46.1 |
| 2016/0059243 | A1 * | 3/2016 | Parisi-Amon | B05B 1/169 239/444 |

* cited by examiner

ADJUSTABLE SHOWER SYSTEM

CROSS-REFERENCE TO RELATED APPLICATIONS

This Application claims the benefit of U.S. Provisional Application No. 62/373,237, filed on 10 Aug. 2016, which is incorporated in its entirety by this reference.

This Application is related to U.S. patent application Ser. No. 15/273,684, filed on 22 Sep. 2016, which is incorporated in its entirety by this reference.

TECHNICAL FIELD

This invention relates generally to the field of shower systems and more specifically to a new and useful height-adjustable shower system and shower mounting system in the field of shower systems.

DESCRIPTION OF THE EMBODIMENTS

Figure 1A:
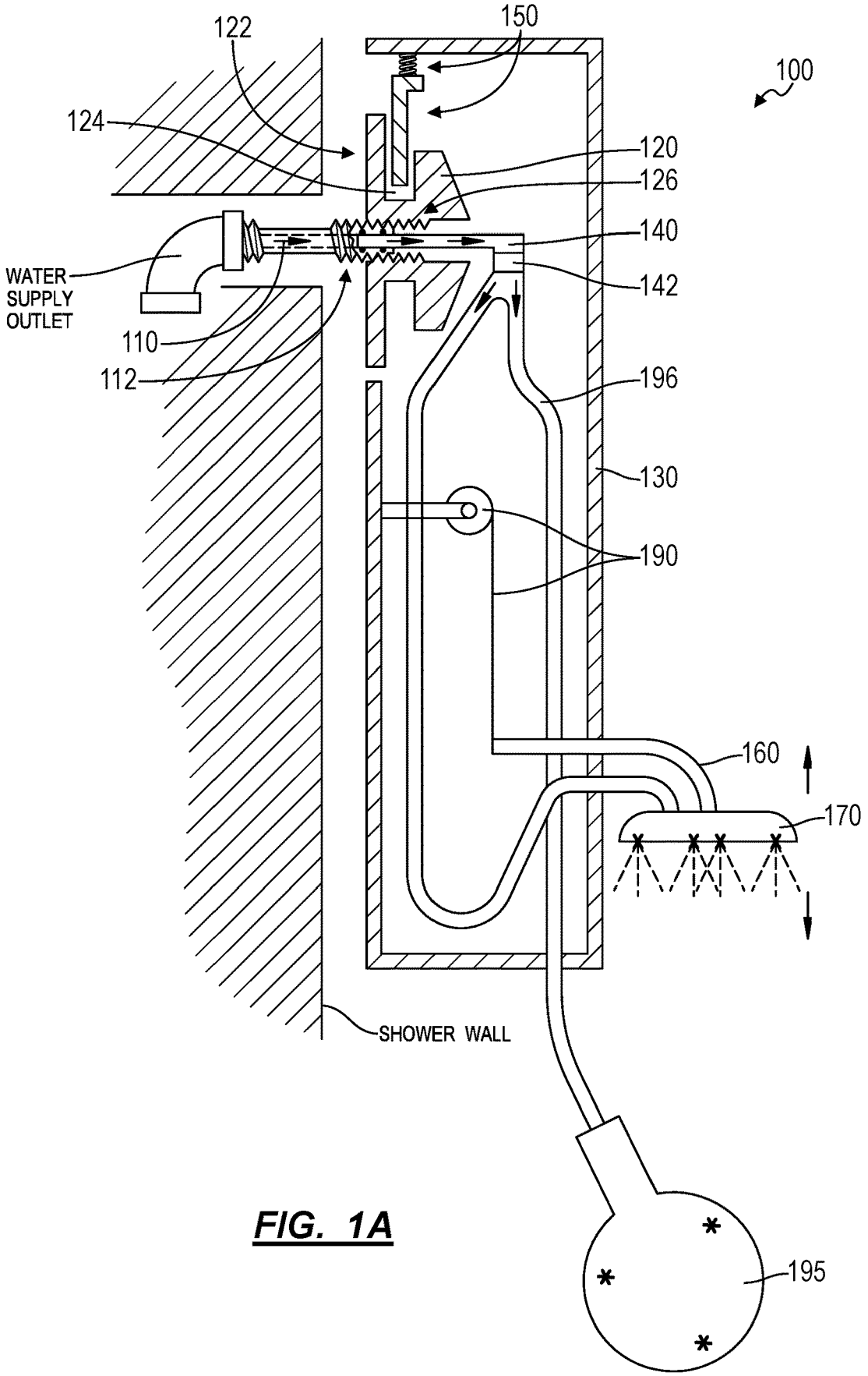
FIGS. 1A and 1B are schematic representations of implementations of the shower system.

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Shower System

As shown in FIGS. 1A and 1B, 2, and 8, a system 100 includes a pipe adapter 110 defining an inlet configured to thread into a water supply outlet adjacent a shower wall, defining an external threaded section opposite the inlet, and defining an internal bore between the inlet and the external threaded section 112; a collar 120 defining: a surface 122 configured to face the shower wall; a retention feature 124 offset from the surface; and an internal threaded section 126 defining an axis normal the surface, the internal threaded section 126 configured to mate with the external threaded section 112 of the pipe adapter 110 to position the surface approximately flush with the shower wall; a bracket 130 defining an opening configured to accept the collar 120 and extending along a longitudinal axis; a nipple 140 flexibly coupled to the bracket, configured to insert into the pipe adapter 110, and comprising a seal configured to mate with the internal bore; a latch 150 coupled to the bracket 130 and configured to transiently engage the retention feature 124 to constrain the bracket 130 against the collar 120 and to retain the nipple inside the pipe adapter 110; an arm 160 configured to translate linearly along the bracket 130 parallel the longitudinal axis; a shower head 170 coupled to the arm 160; a hose 180 fluidly coupled to the nipple and to the shower head; and a spring 190 configured to apply a force on the arm 160 against the bracket 130 to counter the weight of the arm 160, the shower head, and fluid contained in the hose 180.

A variation of the system 100 includes: a pipe adapter defining an inlet configured to thread into a water supply outlet adjacent a shower wall, defining an external threaded section opposite the inlet, and defining an internal bore between the inlet and the external threaded section; a collar defining: a surface configured to face the shower wall; a retention feature 124 offset from the surface; and an internal threaded section 126 defining an axis normal the surface, the internal threaded section 126 configured to mate with the external threaded section 112 of the pipe adapter 110 to position the surface approximately flush with the shower wall; a nipple configured to insert into the pipe adapter 110 and comprising a seal configured to mate with the internal bore; a shower head defining a nozzle fluidly coupled to the nipple; and a latch coupled to the shower head 170 and configured to transiently engage the retention feature 124 to constrain the shower head 170 against the collar 120 and to retain the nipple inside the pipe adapter 110.

2. Applications

Generally, the system 100 is configured to install securely in any of a variety of bathing environments, discharge water droplets into a bathing environment through a shower head, and mechanically adjust a position of the shower head 170 to vary temperature and water-pressure sensation of the water droplets.

The system includes an adjustable connection configured to install and secure the system flush with a shower wall without damaging, drilling into, or otherwise compromising the shower wall by mechanically coupling the system directly to the water supply outlet (e.g., behind the shower wall). Thus, the adjustable connection, which includes the pipe adapter 110, the collar, and the latch, can be configured to constrain the bracket 130 flush with a plane of the shower wall regardless of a depth of the water supply outlet behind the shower wall, which may vary significantly among bathing environments due to lax plumbing standards. As described below, each pipe adapter can accommodate water supply outlets within a range of depths behind the shower wall by engaging a subsection of the (total) length of the collar 120 until the surface of the collar 120 is flush or abutted with the wall. Thus, the system can install substantially flush with the shower wall in a variety of bathing environments.

A user may install the system by: screwing the pipe adapter 110 into the water supply outlet (e.g., a dropear elbow) located behind, flush with, or slightly proud of a shower wall; threading the collar 120 onto the pipe adapter until flush with a plane of the shower wall; aligning the nipple with the internal bore of the pipe adapter 110; and pressing the bracket, arm, and shower head toward the shower wall until the latch 150 engages the collar. Once installed, the pipe adapter 110 can communicate fluid (i.e., water) from the wall plumbing, through a fluid circuit, to the shower head 170, which then disperses this water in small fluid droplets into a bathing environment, such as a shower stall. Thus, the latch 150 can function to secure and constrain both hydraulic and mechanical connections between the bracket 130 and the pipe adapter 110. Furthermore, the system can be configured to be uninstalled from the water supply outlet easily and without permanent damage to the shower wall and/or internal plumbing by disengaging the latch 150 from the collar, thereby releasing the bracket, arm, and shower head from the collar.

2.1 User Experience

As described below, the system includes a bracket that mounts to the wall, an arm that slides up and down the bracket and supports the shower head distal from the bracket, thereby enabling a user to adjust the height of the shower head quickly and conveniently with a single hand. In particular, the system includes a height adjustable mechanism configured to translate (and/or tilt) the shower head 170 upward or downward in response to an input displacing the arm 160 upward or downward and retain the shower head 170 at a fixed height in the absence of the input displacing the arm 160 upward or downward without depressing a button or otherwise locking the arm 160 in place. For example, the system can include a spring element (e.g., a "constant-force" spring) configured to counter weight of the arm 160, the shower head, and fluid flowing through the arm 160 such that the shower head 170 and the arm 160 remain in a static position in the absence of manipulation by a user, thereby preserving a pressure and temperature sensation experienced by the user, which may be a function of the vertical position (and/or angle) of the shower head 170 above the user's head, as set by the user while showering under the system 100.

Figure 7:
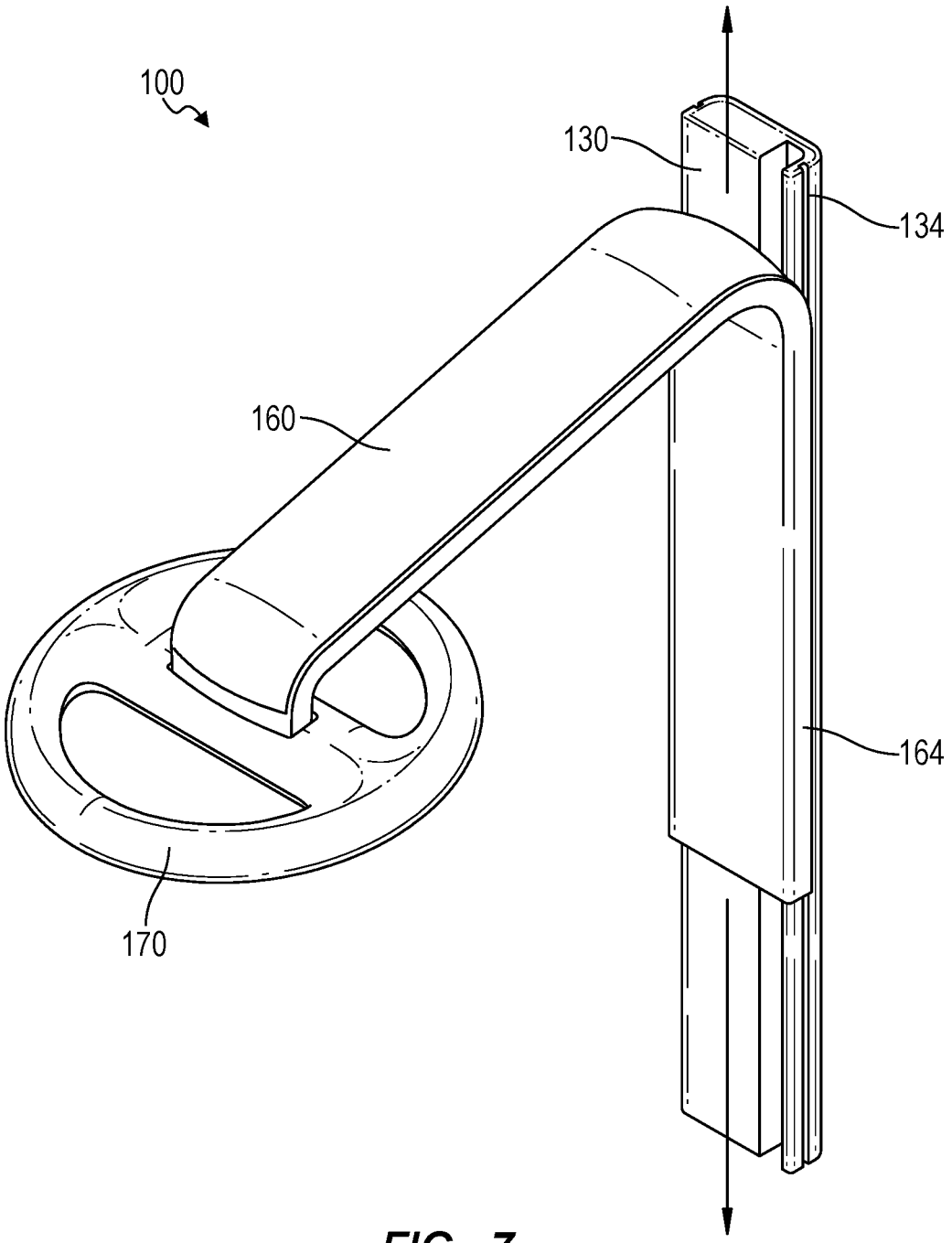
FIG. 7 is a schematic representation of one variation of the system.
Figure 8:
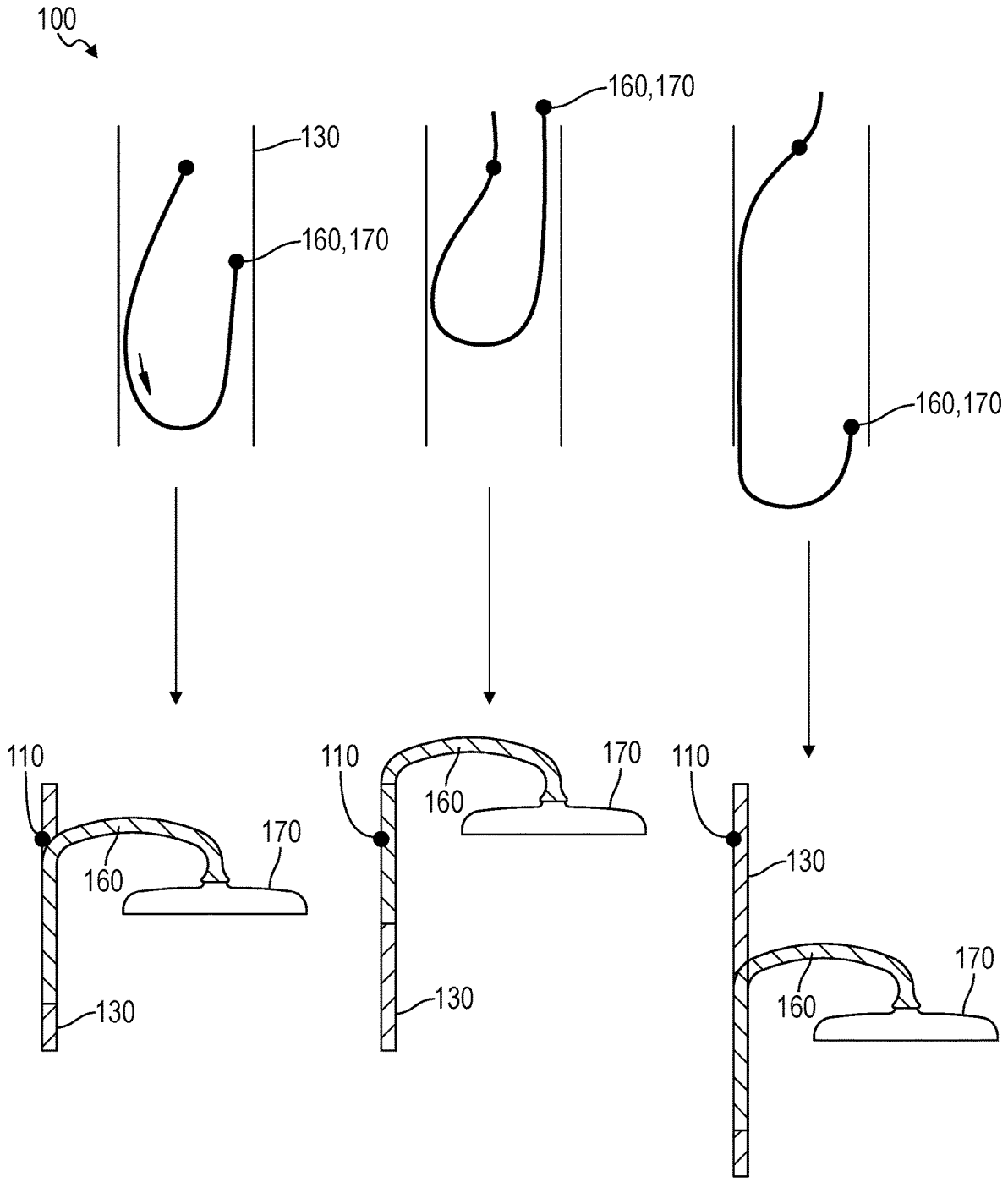
FIG. 8 is a flowchart representation of one implementation of the system.
Figure 9:
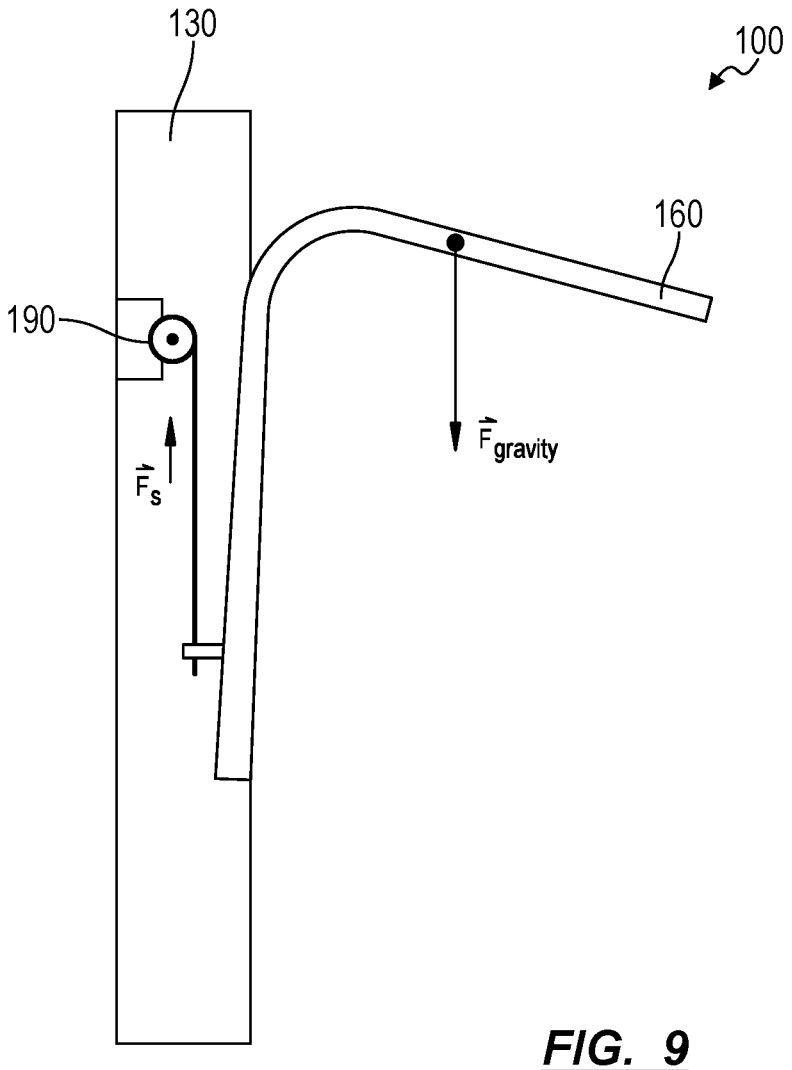
FIG. 9 is a schematic representation of one implementation of the system.

As shown in FIGS. 7, 8, and 9, a user may manipulate the shower head 170 and arm to various heights, thereby varying distance of the shower head 170 relative to the user. By lowering the height of the arm 160 and showerhead 170 on the bracket, the user may focus flow from the shower head 170 toward a portion of the user's body for a concentrated sensation of flow (e.g., "spray force" or "water pressure") to aid rinsing of debris and cleaning aids (e.g., soap) from the user's body by moving the shower head 170 vertically closer to the skin of the user. Alternatively, by raising the arm 160 and showerhead 170 on the bracket, the user may experience a less intense sensation of flow and a softer experience compared to a more intense sensation that may occur when the shower head 170 is lowered toward the user. Thus, by adjusting the height of the shower head 170 on the bracket, the user may control the sensation of water impact on her skin while showering.

Furthermore, by supporting a range of vertical positions of the shower head 170 on the bracket, the system can also enable the user to vary a sensation of temperature of water hitting her skin while showering under the system 100. As described below, the system can include a shower head that discharges small (e.g., ~200 micrometer to 800 micrometer in diameter) water droplets from nozzles. The closer the shower head 170 is to a user, the less heat-energy may be dissipated from water droplets discharged from the shower head 170 to ambient before these water droplets reach the user's skin, thereby yielding a sensation of higher water temperature. In particular, the user may increase temperature of water colliding with her skin by decreasing the distance between the user and the shower head—rather than by adjusting a water control valve external to the system—thereby decreasing a distance traversed by water droplets from the shower head 170 to the user's skin and decreasing a time over which these water droplets may dissipate heat-energy to ambient before reaching the user's skin. Likewise, the user may decrease temperature of water colliding with her skin by increasing the distance between the user and the shower head, thereby increasing the distance and time over which water droplets discharged from the shower head 170 dissipate heat-energy to ambient.

For example, as described in U.S. patent application Ser. No. 15/273,684, the shower head 170 can be configured to discharge water droplets between 100 and 600 micrometers in diameter; such small water droplets exhibit high ratios of surface area to volume and may thereby rapidly dissipate heat-energy to ambient. By supporting a wide range of vertical positions of the arm 160 on the bracket 130, the system can enable the user to conveniently set the position of the shower head 170 over her head and thus conveniently adjust the temperature of water reaching her skin without adjusting a water temperature value integrated into her shower. In particular, the system can enable fine, high-resolution adjustment of water temperature experienced by a user through adjustment of the vertical position of the shower head 170 rather than through adjustment of a water temperature value integrated into her shower, which may exhibit poor or lower-resolution temperature control.

2.2 Mechanical and Fluid Connection

Generally, water supply outlets exit shower walls—or align with a port through the shower wall for insertion of the pipe adapter 110—at non-standard and varying heights depending on preference of a plumber who constructed the bathing environment and installed the water supply outlet. For example, in a first bathing environment (e.g., a shower), the water supply outlet can align with a port in the shower wall 1.5 meters above a floor of the first bathing environment; in a second bathing environment, the water supply outlet can align with a port in the shower wall 2.25 meters above a floor of the second bathing environment. For a user 1.8 meters tall, a static shower head installed in the first bathing environment and fixed at the height of the port in the shower wall can fall below the user's head and increase difficulty of showering underneath the shower head. However, a static shower head installed in the second bathing environment and fixed at the height of the port in the shower wall of the second bathing environment can hover well above the user's head at such a distance that water dispersed by the shower head 170 is cold when it reaches the user. However, the system can be installed in the first bathing environment and can be configured to allow the user to vertically adjust the arm 160 and the shower head 170 above her head; the system can also be installed in the second bathing environment and can be configured to allow the user to vertically adjust the shower head 170 to a height just above the user's head. Thus, the system can adjust the height of the shower head 170 to normalize non-standardized heights of water supply outlet and disperse water onto users of various height according to their showering preferences.

Similarly, multiple users of varying heights may shower under the system. For example, a family of four may include four unique users of four vastly different heights. During a shower, each unique user may adjust the shower head 170 vertically to correspond with one's height, one's water-temperature preference, and one's water-sensation preference.

Furthermore, the system 100 includes a collar 120 that cooperates with the shower wall to limit pitch rotation of the system about the water supply outlet-pipe adapter joint. In some plumbing setups, the water supply outlet can be loose (e.g., wiggly), skew (e.g., non-orthogonal) to the plane of the shower wall, or otherwise insecure and unable to support a large system against vertical and pitch displacement without significantly damaging the shower wall and/or internal plumbing behind the wall. Thus, the collar 120 can be configured to brace the system against the wall, limit pitch and vertical displacement of the system, and secure the system during translation of the arm 160 (and the shower head) along the longitudinal axis of the bracket.

Thus, the system can be configured to install in a variety of bathing environments and accommodate users of a variety of different shapes and sizes regardless of internal plumbing structure.

3. Pipe Adapter

As shown in FIGS. 1A, 1B, 2, and 3A-3D, the system 100 includes a pipe adapter 110 defining an inlet configured to thread into a water supply outlet adjacent a shower wall, defining an external threaded section opposite the inlet, and defining an internal bore between the inlet and the external threaded section 112. Generally, the pipe adapter 100 is configured to mate with (i.e., thread into) a water supply outlet located behind or flush with a shower wall and communicate fluid from the water supply outlet to the hose 180 of the system through the internal bore.

The pipe adapter 110 can be machined (e.g., turned), molded (e.g., injection molded or cast), and/or otherwise manufactured of any material, such as plastic or metal, suitable to support the weight of the system 100 and weight of fluid communicated through the system against vertical (e.g., gravitational) forces.

3.1 Inlet

The pipe adapter 110 can include an inlet and an inlet threaded section, which can include external (i.e., "male") or internal (i.e., "female") threads configured to mate with (i.e., thread into) threads of the water supply outlet. In one implementation, the inlet threaded section can include "male" external threads. In this implementation, the inlet threaded section can be configured to mate with internal (e.g., "female") threads of the water supply outlet (e.g., a dropear elbow). In the United States, the water supply outlet can include a "female" threaded port with National Pipe Taper (hereinafter "NPT") threads. Thus, the pipe adapter 110 can include "male" NPT threads arranged along the entire length or a portion of the length (e.g., 1.5 inches) of the pipe adapter 110 proximal the inlet of the pipe adapter 110.

Alternatively, the water supply outlet can include any other thread type, such as male NPT, male or female British Standard Pipe Taper (BSPT), or male or female British Standard Parallel Pipe (BSPP) threads. Thus, the pipe adapter 110 can include threads (e.g., straight and/or tapered) configured to mate with threads and thread tapers of the water supply outlet, such that the pipe adapter 110 can thread into the water supply outlet. Therefore, the pipe adapter 110 can function to communicate fluid from the water supply outlet through the internal bore while limiting leakage of fluid through a joint mechanically adjoining the pipe adapter 110 to the water supply outlet.

The pipe adapter 110 can be installed into (i.e., threaded into) a water supply outlet arranged behind a shower wall of a shower stall. The water supply outlet, such as a dropear elbow with internal (i.e., female) threads connected to an internal plumbing water supply directed through a house from a water main, can be offset behind the shower wall by different distances depending on internal plumbing of the house. In one shower installation, the water supply outlet can be offset behind the shower wall by a greater distance than in another shower installation, in which the water supply outlet is substantially flush with an external surface of the shower wall. Thus, in order to install the bracket 130 substantially flush with the shower wall, the pipe adapter 110 and the collar 120 can be configured to accommodate different distances of the water supply outlet behind the wall while retaining the system flush with the shower wall in all of the above installations (e.g., flush with the shower wall).

The pipe adapter 110 and the water supply outlet can cooperate to form a seal between the water supply outlet and the pipe adapter 110, thereby limiting leakage of fluid through the joint (e.g., mating threads) adjoining the pipe adapter 110 to the water supply outlet. Alternatively, plumbing putty, polytetrafluoroethylene (PTFE) tape (i.e., "plumber's tape"), caulk, and/or any other sealant can be applied to the water supply outlet and/or the pipe adapter 110 to fill gaps between threads of the water supply outlet and the pipe adapter 110 and limit leakage of fluid through the joint adjoining the pipe adapter 110 to the water supply outlet. The pipe adapter can also be brazed, welded, soldered, and/or permanently coupled to the water supply outlet in any other suitable way.

Additionally or alternatively, the system can include an elastomer gasket, O-Ring, and/or other compressible material that the pipe adapter 110 compresses against the water supply outlet as the pipe adapter 110 screws into the water supply outlet. As the elastomer gasket is compressed, the compressible material expands into crevices between the pipe adapter 110 and the water supply outlet, forming a seal and limiting leakage between the joint. Alternatively, the sealant can be any other sealing mask or device that limits friction—opposing torque as the pipe adapter 110 screws into the water supply outlet. For example, the sealant can include a lubricious and/or viscous coating applied to the pipe adapter 110 threads that fills gaps between the threads of the water supply outlet and the pipe adapter 110.

3.2 Internal Bore

The pipe adapter 110 can define an internal bore between the inlet of the pipe adapter 110 and an outlet of the pipe adapter 110, the internal bore configured to communicate fluid from the water supply outlet through the pipe adapter 110. In one implementation, the internal bore can include an approximately smooth, reamed cylindrical hollow. Alternatively, the internal bore can be of any other geometry configured to communicate fluid across the pipe adapter 110 while minimizing water pressure losses due to friction with a surface of the internal bore.

Additionally or alternatively, the pipe adapter 110 can include internal (female) threads or grooves on an internal surface of the pipe adapter 110. The internal threads or grooves can be arranged along the entire length of the pipe adapter 110 or at discrete segments within the pipe adapter 110.

Furthermore, the pipe adapter can include internal features configured to mate with an installation tool to aid installation. For example, the pipe adapter can include a slot in the internal bore of a rectangular profile configured to accept a rectangular installation tool.

3.3 External Threaded Section

Figure 2:
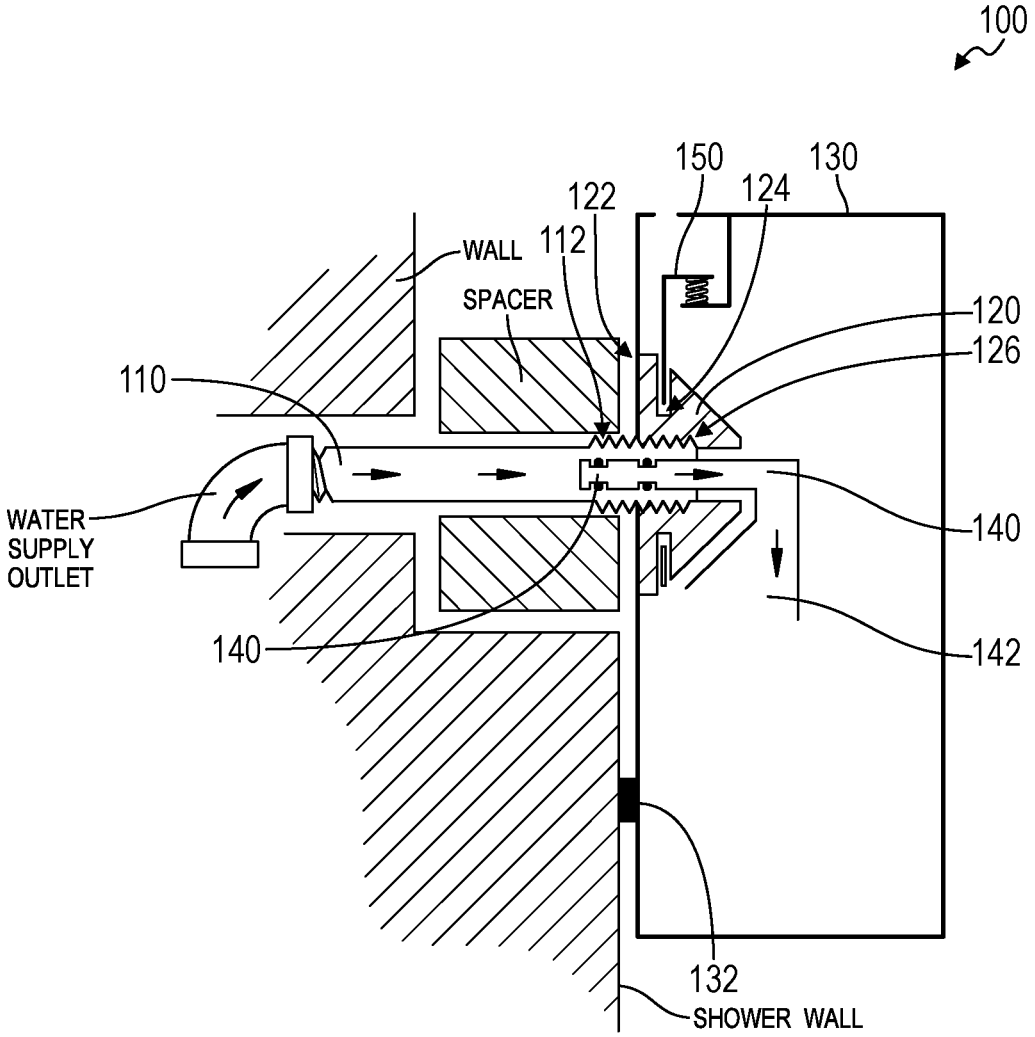
FIG. 2 is a schematic representation of one implementation of the system.

Additionally, the pipe adapter 110 can also include an external threaded section opposite the inlet proximal the outlet of the pipe adapter 110. Thus, as shown in FIG. 2, the pipe adapter 110 can include: the inlet threaded section and the external threaded section 112 proximal the outlet and opposite the inlet threaded section. Generally, the external threaded section 112 can be configured to accept (i.e., mate with) and support the collar 120

As described below, the external threaded section 112 can include "male" threads, such as M20 straight threads, machined, molded, and/or otherwise integrated into an external surface of the pipe adapter 110 proximal the outlet. The external threaded section 112 can include straight or tapered threads and can extend along a section of external surface of the pipe adapter 110 such that, when the pipe adapter 110 is threaded into (i.e., installed) the water supply outlet, the external threaded section 112 (or a portion of the external threaded section) is exposed proud of the shower wall.

Alternatively, the external threaded section 112 can include "female" internal threads integrated (i.e., machined or molded) into the internal bore of the pipe adapter 110 and configured to accept a "male" threaded collar.

Alternatively, the remaining portion of the pipe adapter 110 can include a series of discrete grooves arranged along the length of the pipe adapter 110.

3.4 Intermediation Section

The pipe adapter 110 can also include an intermediate section between the inlet threaded section and the external threaded section. The intermediate section can include an unthreaded external diameter configured to prevent the pipe adapter 110 from threading beyond an end of the inlet threaded section into the water supply outlet and configured to prevent the collar 120 from threading beyond an end of the external threaded section.

Alternatively, the intermediate section of the pipe adapter 110 can include threads of a different pitch, a different taper, or a different outer diameter or circumferential geometry (e.g., polygonal) from the pitch, the taper, and the thread spacing of the inlet threaded section and/or the external threaded section. For example, the inlet threaded section can include NPT threads and the intermediate and external threaded section can include untapered M15 by one millimeter threads.

3.5 Multiple Pipe Adapters

In one implementation, the system 100 includes multiple (e.g., a "kit" of) pipe adapters, each of a unique length. When a first threaded section at an inlet end of a pipe adapter is threaded into a water supply outlet behind a shower wall, a second threaded section at the opposite end of the pipe adapter extends beyond (i.e., proud of) an external surface of the shower wall. In particular, the outlet end of a pipe adapter—opposite its inlet end—can extend proud of the of the shower wall by a distance equal to the pipe adapter length less an offset of the water supply outlet behind the shower wall. For example, in a first shower setup, the water supply outlet can be located three inches behind an external surface of the shower wall; in a second shower setup, the water supply outlet can be located 0.5 inches behind the external surface of the shower wall. For a pipe adapter of a length of four inches, for example, in the first shower setup, the pipe adapter 110 can extend one inch proud of the external surface of the shower wall. In the second shower setup, the pipe adapter 110 can extend 2.5 inches proud of the shower wall.

Therefore, in addition to a first pipe adapter 110, the system 100 can also include a second pipe adapter interchangeable with the first pipe adapter 110 but of an overall length different from that of the first pipe adapter 100 (e.g., characterized by a different length between its inlet and external threaded section). The first pipe adapter no can define the external threaded section 112 over a first range of distances from the inlet of the pipe adapter 110 (e.g., between 1-2.5 inches from the inlet). The second pipe adapter can, like the first pipe adapter 110, also define a second inlet configured to thread into the water supply outlet adjacent the shower wall, define an external threaded section over a second range of distances from the second inlet of the second pipe adapter (e.g., between 2.5-4 inches from the inlet), and define an internal bore between the second inlet and the second external threaded section. Thus, the second range of distances can be distinct from (or slightly overlap) the first range of distances. In this implementation, a user may select either the first pipe adapter 110 or the second pipe adapter when installing the system in a shower in order to achieve a target offset distance between an outlet end of an installed pipe adapter and the external surface of the shower wall.

For example, in a particular bathing environment, a user may select the first pipe adapter 110 to position threads of the external threaded section 112 coincident a plane (e.g., the external surface) of the shower wall when the pipe adapter 110 is threaded into the water supply outlet. However, if the pipe adapter 110 is too short, when the first pipe adapter 110 is threaded into the water supply outlet, the outlet of the pipe adapter 110 may terminate behind the external surface of the wall. Thus, the user may select the second pipe adapter, which is longer than the first pipe adapter, to position threads of the second external threaded section coincident (e.g., aligned with) a plane of the shower wall when the second pipe adapter is threaded into the water supply outlet.

The system 100 can include additional pipe adapters of different lengths and ranges of distances, wherein each pipe adapter is interchangeable and selectable by a user to achieve alignment of threads of the external threaded section of an installed pipe adapter with a plane of the shower wall.

4. Collar

Figure 3A:
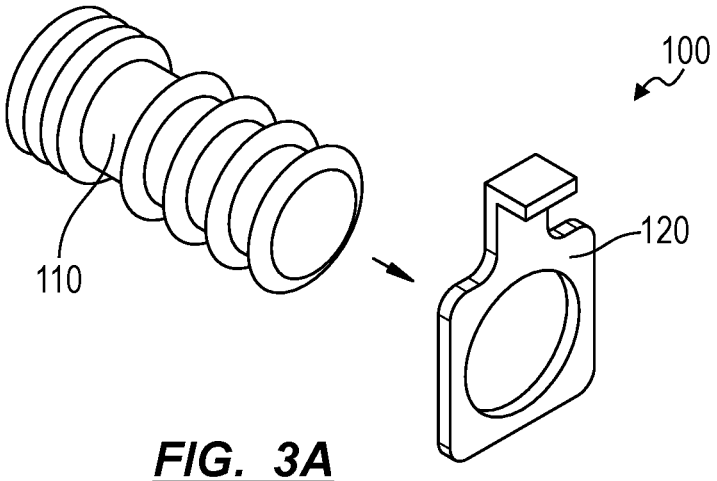
FIGS. 3A-3D are schematic representations of an implementation of the system.
Figure 3B:
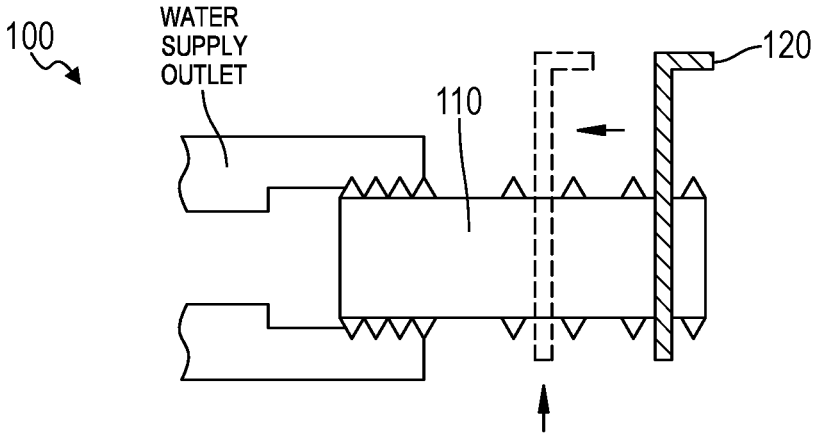
Figure 3C:
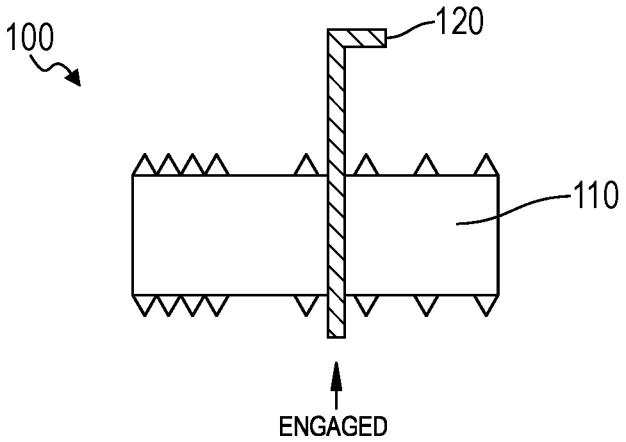
Figure 3D:
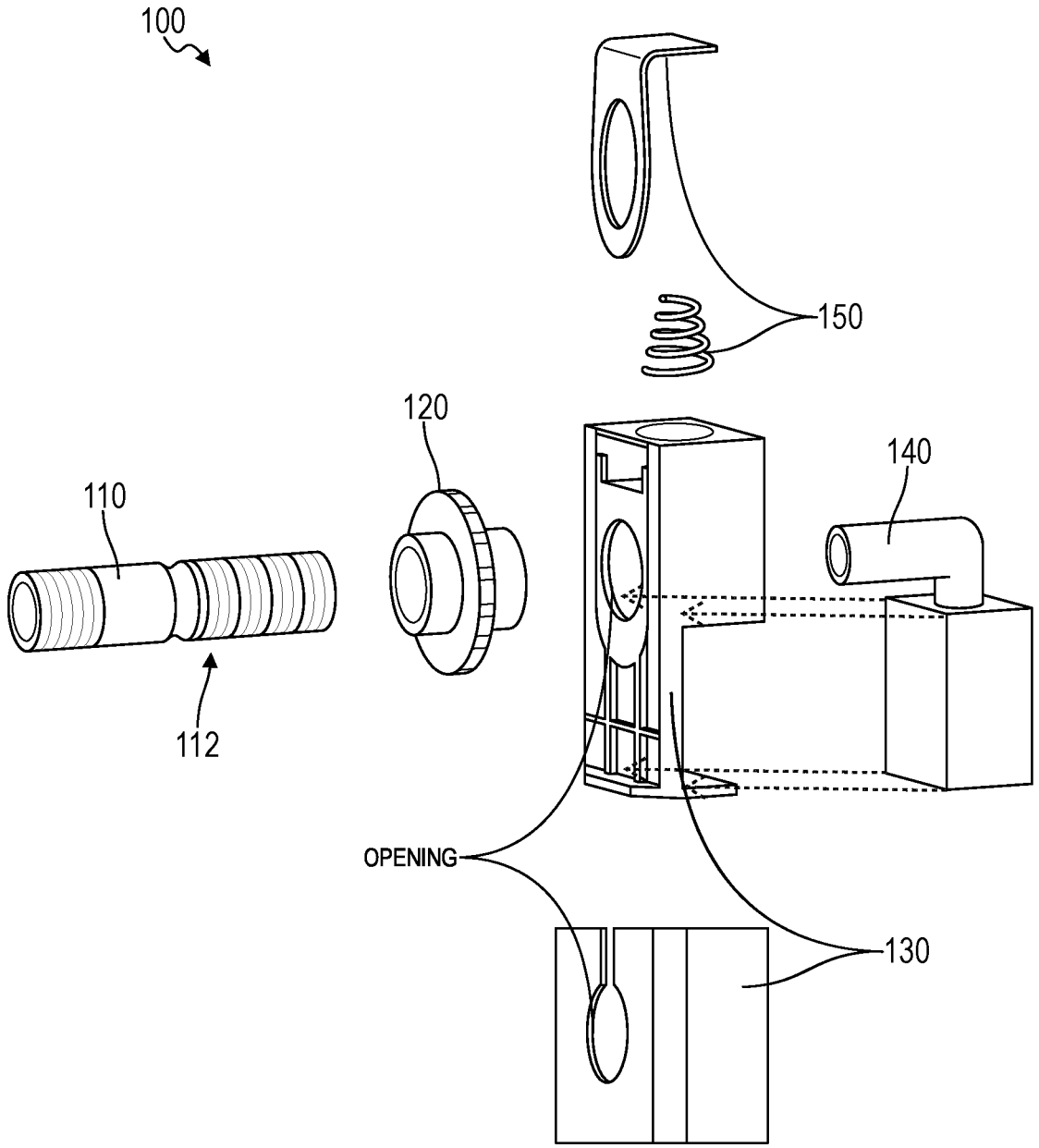

As shown in FIGS. 1A and 3D, the system 100 includes a collar 120 defining: a surface 122 configured to face the shower wall; a retention feature 124 offset from the surface; and an internal threaded section 126 defining an axis normal the surface, the internal threaded section 126 configured to mate with the external threaded section 112 of the pipe adapter 110 to position the surface approximately flush with the shower wall. Generally, the collar 120 functions to thread onto the external threaded section 112 of the pipe adapter 110 (i.e., when the pipe adapter 110 is threaded into the water supply outlet) toward the inlet until the surface of the collar 120 is approximately flush with the shower wall or a feature (e.g., an intermediate gasket or spacer) between the collar 120 and the shower wall.

The collar 120 can be molded, cast, and/or machined of any material, such as a lubricious plastic. In one implementation, the collar 120 can define the internal threaded section 126 configured to form a sliding (i.e., clearance) fit with the external threaded section 112 of the pipe adapter 110. The internal threaded section 126 can thread onto the pipe adapter 110 freely and, once threaded onto the pipe adapter 110, the collar 120 can rotate about the rotational axis defined by the pipe adapter 110. Thus, the collar 120 can be configured to provide rotational freedom about the water supply outlet, such that rotational displacement of the bracket 130 about the rotational axis avoids disconnecting (e.g., unscrewing) the mechanical and/or the fluid connection between the water supply outlet and the system.

The collar 120 can define the internal threaded section 126 spanning a length of the collar 120 and configured to thread the collar 120 completely or partially onto the external threaded section 112 of the pipe adapter 110 until the surface of the collar 120 is flush with a plane of the shower wall or a feature interspersed between the collar 120 and the shower wall. For example, a pipe adapter of length of 3" can thread into a water supply outlet offset behind an external surface of the shower wall by 2.5". Thus, the pipe adapter 110 can protrude proud of the external surface of the shower wall by 0.5". In this example, a collar defining a length of 1" between the surface and an end of the collar 120 opposite the surface, can thread up to 0.5" of the length of the collar 120 onto the pipe adapter 110 before interfering with the shower wall.

The collar 120 can define the length of the collar 120 equal to or less than a length of the external threaded section 112 of the pipe adapter 110. Thus, the internal threaded section 126 can stop threading (i.e., "bottom out") on the unthreaded intermediate section of the pipe adapter 110 such that the end of the collar 120 is flush with or slightly proud of the outlet of the pipe adapter 110 when the collar 120 is fully threaded onto the external threaded section. The end of the collar 120 can be configured to be positioned proud of or flush with the outlet of the pipe adapter 110 at any position in the range of distances defined by the pipe adapter 110.

The collar 120 can also define a minimum thread engagement between the pipe adapter 110 and the collar 120 (i.e., a minimum number of threads of the internal threaded section 126 engaging the external threaded section 112 of the pipe adapter 110) to secure the collar 120 against the pipe adapter 110. For example, the collar 120 can define a minimum thread engagement of three threads. If the two threads of the internal threaded section 126 engage two threads of the pipe adapter 110 when the surface of the pipe adapter 110 is flush with the shower wall, the pipe adapter is too short and the collar 120 engages fewer than the minimum number of threads necessary to resist hydraulic forces applied on the system by water output from the water supply outlet. As described above, the user may select a second pipe adapter longer than the first pipe adapter 110 to increase thread engagement by exposure to a larger number of threads proud of the external surface of the shower wall.

The collar 120 can define the surface configured to face the shower wall. The collar 120 can define a tapered section extending away from the surface toward an end of the collar 120 opposite the surface. The collar 120 can define the tapered section on an external surface of the collar 120 (i.e., opposite the internal threaded section) such that the tapered section increases gradually from a first diameter proximal the end of the collar 120 to a second diameter larger than the first diameter proximal a retention feature 124 of the collar. Thus, the tapered section can function as a lead-in configured to facilitate alignment of the opening of the bracket 130 with the collar 120 during installation of the bracket 130 over the collar.

The collar 120 can also define a retention feature, such as a groove, slot, or trench, between the surface and the tapered section, such that, during installation, the tapered section guides the latch 150 into alignment with the retention feature.

The collar 120 can be configured to tension threads of the inlet threaded section of the pipe adapter 110 against the water supply outlet when the collar 120 is threaded onto the pipe adapter 110 until the surface of the collar 120 is abutted with and applying pressure on the shower wall. The collar 120 can further define a flange between the surface and the retention feature. The flange can be of a diameter equal to or larger than a maximum diameter of the tapered section and can be configured to engage an external surface of the shower wall surrounding an opening in the shower wall through which the pipe adapter 110 protrudes. In this implementation, the flange of the collar 120 can be configured to brace the pipe adapter 110 against displacement by interfacing with the external surface of the shower wall and resisting forces displacing the pipe adapter 110, the water supply outlet, and, as described below, the bracket 130 in vertical and/or pitch orientations.

Alternatively, the collar 120 can include external ("male") threads configured to mate with internal threads integrated in the internal bore of the pipe adapter 110.

However, the collar 120 can be configured to mate with the pipe adapter 110 in any other suitable way.

4.1 Spacer

In one variation of the system shown in FIG. 2, the system 100 can include a spacer configured to mount concentrically over an external surface of the pipe adapter 110 between the surface of the collar 120 and the external surface of the shower wall. Generally, the spacer functions to fill a void between the surface of the collar 120 and the shower wall in response to the external threaded section 112 positioned proud of and offset from the external surface of the shower wall by a distance.

In one application, the shower wall can include a ledge adjacent (i.e., offset below) an opening in the shower wall through which the pipe adapter 110 traverses the shower wall. In this application, the shower wall can define a first surface, which defines the opening, and a second surface proud of and offset from the first surface by a width of a ledge, the collar 120 configured to constrain the bracket 130 flush with the second surface. Thus, the pipe adapter 110 can exit the shower wall through the opening in a first surface of the shower wall and the collar 120 can be configured to align the surface of the collar 120 with second surface of the shower wall. The spacer of a width corresponding to the width of the ledge can be installed over the pipe adapter 110 to fill a gap between the first surface and the surface of the collar.

As described above, the collar 120 can tension threads of the inlet threaded section of the pipe adapter 110 against the water supply outlet by threading (e.g., "tightening down") onto the pipe adapter 110 until the surface of collar applies pressure on the spacer compressing the spacer toward the first surface and is aligned with the second surface of the shower wall. Thus, the collar 120 can securely retain the bracket 130 flush with the second surface.

Furthermore, the spacer can function as an escutcheon and/or seal configured to limit influx of water into the shower wall (e.g., from the shower stall through the opening in the shower wall to a void behind the shower wall). Thus, the spacer can mate with the shower wall around the pipe adapter and the nipple to form a seal surrounding the opening in the shower wall, the pipe adapter, and the nipple.

5. Bracket

As shown in FIGS. 1A, 1B, 6, and 8, the system 100 includes a bracket 130 defining an opening configured to accept the collar 120 and extending along a longitudinal axis. Generally, the bracket 130 functions to hang on the collar; as described below, to support the arm 160, shower head, and hoses; and to house and protect the hose 180.

The bracket 130 can define a long (e.g., 25-27 inches) extruded, machined, cast, and/or molded structure of metal (e.g., Aluminum) and/or plastic configured to support the weight of the arm 160, shower head, hoses, and any other internal components to the system against vertical displacement on the wall.

The bracket 130 can define an opening configured to accept the collar 120 and the pipe adapter 110. As described below, the bracket 130 can be latched, screwed, adhered, welded, or otherwise connected to the collar 120 near the opening of the bracket 130 to constrain the bracket 130 adjacent (i.e., parallel) the shower wall.

The bracket 130 can define a longitudinal axis extending parallel the length of the bracket. In one implementation, the length of the bracket 130 can be greater than a width of the bracket.

The bracket 130 can also house and support the hose 180. The bracket 130 or features within the bracket 130 can retain the hose 180 against the pipe adapter 110 and reinforce the seal between the hose 180 and the pipe adapter 110. In one implementation, the bracket 130 can also include a second opening parallel the longitudinal axis through which the hose 180 can exit the bracket 130 and mount to the arm 160. Thus, the hose 180 can communicate fluid from the nipple, through the bracket, onto the arm 160, and to the shower head 170 supported by the arm 160. In this implementation, the hose 180 can form a loop within the bracket 130 (e.g., a U-shaped loop), wherein a width of the loop approximates a width of the bracket. As the arm 160 slides upward and downward, the hose 180 translates with the arm 160 along the second opening.

The bracket 130 can also define tracks parallel the longitudinal axis of the bracket. The tracks can be configured to accept a follower defined by the arm 160 as described below and can limit pitch direction racking and displacement of the arm 160 against the bracket.

6. Nipple

Figure 1B:
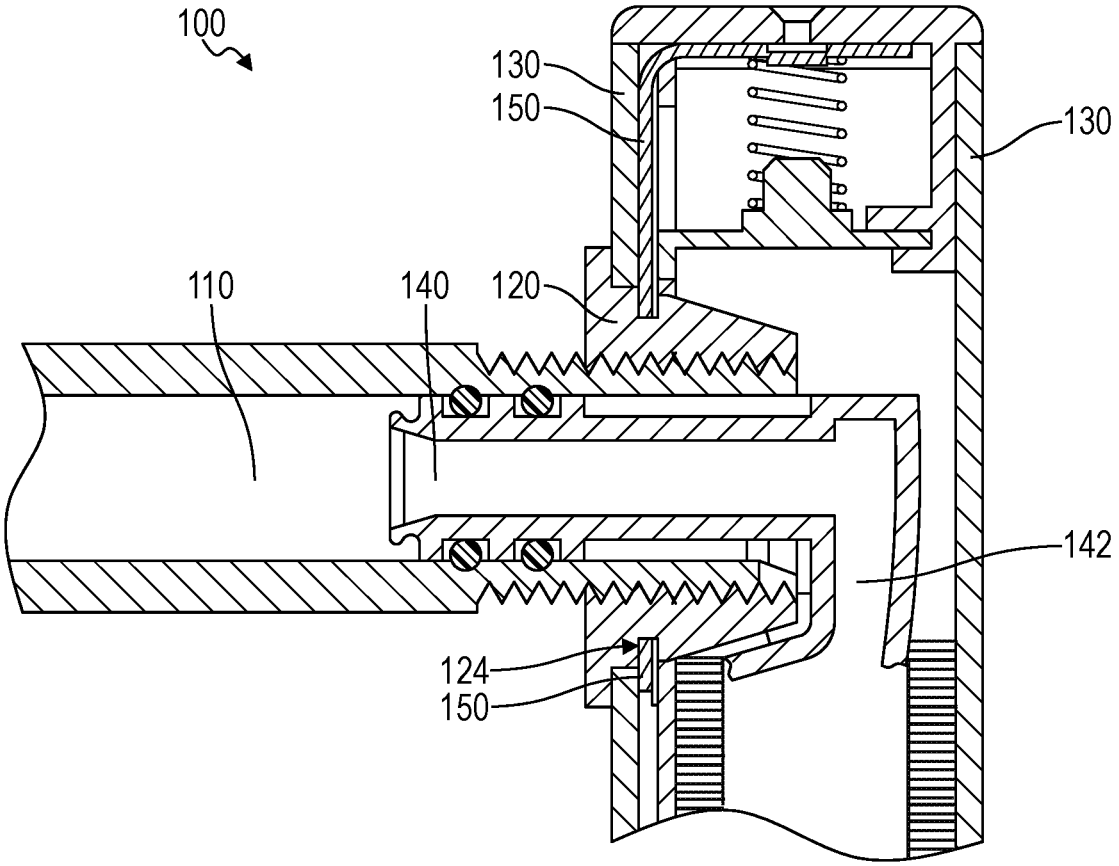

As shown in FIGS. 1A AND 1B, the system 100 includes a nipple 140 flexibly coupled to the bracket, configured to insert into the pipe adapter 110, and including a seal configured to mate with the internal bore of the pipe adapter 110. Generally, the nipple functions to communicate fluid from the pipe adapter 110 to the hoses, thereby defining a fluid connection between the water supply outlet and the system.

The nipple can define a hollow conduit configured to communicate fluid from the pipe adapter 110 to the hoses. The nipple can be configured to insert into the internal bore of the pipe adapter 110. Thus, the nipple can define an external surface of a diameter undersized relative the diameter of the internal bore. The nipple can also include a seal (or multiple seals) such as an elastomer gasket or "O-ring", arranged on the external surface configured to compress against the internal bore of the pipe adapter 110 when the nipple is inserted within the internal bore. The seal can be configured to confine fluid flow from the pipe adapter 110 to the nipple to the hollow (internal) conduit, thereby limiting fluid leakage to an interstitial between the external surface of the nipple and the internal bore of the pipe adapter 110.

The nipple can be flexibly coupled to the bracket 130 proximal the opening of the bracket. In one implementation, the nipple can traverse the opening, a portion of the nipple arranged within the bracket 130, and a second portion of the nipple extending outside the bracket. The bracket 130 can constrain the nipple within the bracket 130 and limit displacement of the nipple away from the longitudinal axis of the bracket 130 while configuring the nipple to rotate and pivot about a mounting point and within a plane of the opening. The nipple can be flexibly coupled to the bracket 130 to constrain the nipple approximately concentric with the opening, thereby avoid overly constraining the nipple relative the opening. During installation of the bracket 130 to the collar, the nipple can align with the internal bore of the pipe adapter 110 while the opening aligns with the collar.

In another implementation, the nipple can form a seal with the external surface of the pipe adapter 110. In this implementation, the nipple can include an inlet with a (female) socket into which the pipe adapter 110 can be inserted. Thus, the internal surface of the inlet of the hose 180 forms a seal with the external surface of the pipe adapter 110. In this implementation, an internal surface of the nipple can be threaded and configured to mate with threads of the external surface of the pipe adapter 110 proximal the outlet of the pipe adapter 110. Alternatively, the inlet of the nipple can be pressed over the external surface of the pipe adapter 110.

However, the nipple can fluidly couple to the pipe adapter 110 in any other suitable way to communicate fluid from the pipe adapter 110 to the hoses.

7. Latch

As shown in FIGS. 1A, 1B, 2, and 3A-3D, the system includes a latch 150 coupled to the bracket 130 and configured to transiently engage the retention feature 124 of the collar 120 to constrain the bracket 130 against the collar 120 and to retain the nipple inside the pipe adapter 110. Generally, the latch 150 functions to retain the bracket 130 against the collar 120 and pipe adapter and constrain the bracket 130 against the wall despite water pressure—from water exiting the water supply outlet—pushing the bracket 130 away from the shower wall and the collar.

The latch 150 can be mounted to an internal surface of the bracket 130 proximal an opening on the back side of the bracket 130 and can be configured to transiently engage the retention feature 124 in the collar 120 when the opening in the bracket 130 is installed over and depressed onto the collar 120.

In one implementation, the latch 150 can include a spring-loaded retention plate (e.g., a stamped sheet-metal plate) coupled to the bracket 130 and configured to ride up the tapered section of the collar 120 as the opening of the bracket 130 is placed over and as the bracket 130 is depressed toward and coaxial the collar 120. Once the retention plate reaches the retention feature, a spring coupled to the retention plate drives the retention plate into the retention feature 124 of the collar 120, thereby constraining the bracket in translation about three-axes and in yaw (i.e., rotation about the axis of the collar and pipe adapter). The retention plate, a section of the bracket below the retention plate, and the collar can also cooperate to constrain the bracket in pitch. However, the latch can decouple the bracket from the collar and constrain the bracket thereby limiting rotation about the axis of the collar (i.e., roll), such that adjustment of the bracket on the shower wall does not unthread the collar from the pipe adapter.

To remove the bracket from the shower wall, the latch can withdraw from the retention feature, thereby releasing the bracket from the collar. For example, a user may insert a tool through an opening proximal the bracket to move the retention plate relative to the collar and thus disengage the retention plate from the retention feature 124.

However, the latch 150 can constrain the bracket against the pipe adapter 110 and/or the collar 120 in any other suitable way.

7.1 Engagement Indicator

In one variation, the bracket 130 can also define a viewing window; and the system can include an indicator coupled to the latch 150 and configured to face the viewing window in response to the retention plate seating into the groove. Thus, the indicator can visually indicate to a user whether the latch 150 has fully seated in the retention feature 124 and whether the bracket 130 is securely constrained against the shower wall. Likewise, the indicator can visually indicate to a user whether the latch 150 is disengaged from the retention feature 124 and whether the bracket 130 is at risk to decouple from (e.g., "fall off") the shower wall.

However, the indicator can indicate engagement of the latch with the bracket in any other suitable way (e.g., audibly).

7.2 Latch Variations

In one variation, the latch 150 can apply a concentrated pressure directly onto the pipe adapter 110 (i.e., without a collar), using pressure to create enough friction between the pipe adapter 110 and the latch 150 to limit slippage of the pipe adapter 110 away from the collar 120 and, thus, the bracket. In one example of this implementation, the latch 150 can include a screw, such as a set screw, with a pointed end or cupped end. When a user tightens the set screw down, the screw threads through the bracket 130 into the external surface of the pipe adapter 110 and/or the retention feature 124 (e.g., a groove) of the collar, exerting pressure on the pipe adapter 110. In this example, the pipe adapter 110 can include a substantially smooth external surface. Thus, the screw can limit slippage of the bracket 130 away from the pipe adapter 110 by digging into the external surface of the pipe adapter 110.

In another variation, the latch 150 can include a clamp that surrounds the pipe adapter 110 and applies pressure directly onto the pipe adapter 110. The clamp can include an opening through which the pipe adapter 110 fits. When the opening is perpendicular to a rotational axis of the pipe adapter 110, the pipe adapter 110 can slide freely through the opening. When the clamp is biased at an angle to the rotational axis, edges of the opening dig into the pipe adapter 110, causing friction between the pipe adapter 110 and the clamp. The clamp can be coupled (e.g., bolted onto, adhered, or otherwise attached) to the bracket, such that by biasing the clamp, the clamp mechanically retains the bracket 130 against the pipe adapter 110 and adjacent the shower wall. Additionally, the clamp can be spring-loaded and default to a biased position in the absence of a force opposing the spring to return the clamp to parallel the axis of the pipe adapter 110 (i.e., disengaged from the pipe adapter 110). Thus, in this implementation, the pipe adapter 110 can be uninstalled from the clamp by compressing the spring.

In one variation, the retention plate can be pulled, pushed, or otherwise driven to engage the external surface of the pipe adapter 110 directly. In this variation, the external surface of the pipe adapter 110 can include grooves and/or threads between which the retention plate can be positioned. Thus, the retention plate can cooperate with the grooves to resist axial motion of the retention plate away from the pipe adapter 110. A spring can push the retention plate to engage the external surface of the pipe adapter 110. In this variation, the spring can default to engage the pipe adapter 110 in the absence of an input driving the retention plate to disengage from the external surface of the pipe adapter 110.

In a similar variation, the latch 150 can include grooves or teeth that dig into the pipe adapter 110 and resist forces (e.g., hydraulic pressure) pulling the latch 150 away from the pipe adapter 110. In this variation, the teeth can be biased at an angle directed away from the inlet of the pipe adapter 110 (i.e., away from direction of installation onto the pipe adapter 110.) As the latch 150 slides over the pipe adapter 110, the teeth drag across the external surface of the pipe adapter 110. When a force presses the collar 120 in an opposing direction (i.e., to remove the collar 120 from the pipe adapter 110), the teeth dig into the pipe adapter 110 resisting removal of the pipe adapter 110 from the teeth. To uninstall the pipe adapter 110 from the latch, a tool can move the teeth away from the external surface of the pipe adapter 110 to alleviate some friction between the teeth and the external surface of the pipe adapter 110. Thus, the teeth can slide over the surface of the pipe adapter 110. In this variation, the latch 150 can engage any surface, such as the internal surface of the pipe adapter 110 and/or the external surface of the pipe adapter 110, of any surface roughness, such as smooth, threaded, grooved.

In another variation, the latch 150 can include a shaft collar coupled to the bracket 130 and configured to tighten circumferentially around the pipe adapter 110 to increase friction between the shaft collar and the pipe adapter 110. In this variation, the shaft collar mounts concentrically about the pipe adapter 110 and can be tightened by compressing a gap in the circumference of the shaft collar, thereby decreasing the space for the pipe adapter 110 inside the shaft collar and squeezing the external surface of the pipe adapter 110. The shaft collar can be tightened and untightened with a screw that pulls one side of the gap toward the other, thereby decreasing the size of the gap and the overall circumference of the shaft collar. Alternatively, the shaft collar can include a CAM lock or any other latching mechanism to alter the gap in the shaft collar and, thus, alter the circumference of the shaft collar. In this variation, the external surface of the pipe adapter 110 can be substantially smooth or can include incremental grooves. The shaft collar can be mounted, bolted, or otherwise coupled to the back of or inside of the bracket 130 and the bracket. Thus, the shaft collar can constrain the pipe adapter 110 at any point along the external surface of the pipe adapter 110 or at discrete locations along the pipe adapter 110.

In another variation, the latch 150 can be connected to an internal surface of the pipe adapter 110 and the bracket, allowing fluid to flow around or though the latch 150 to enter the hose 180. In one example of this variation, the pipe adapter 110 can include internal threads. The latch 150 can include a clover-shaped fitting, which can be screwed into the internal threads. The clover-shaped fitting can be coupled to a rod (e.g., a threaded rod), such that as the clover-shaped fitting screws into the pipe adapter 110, the clover-shaped fitting moves along the length of the rod. The rod can function to couple the clover-shaped fitting to the bracket. Additionally, the rod can retain the hose 180 against the pipe adapter 110. In this example, fluid can flow from the water supply outlet, through the pipe adapter 110, between the leaves of the clover-shaped fitting, around the rod, and into the hose 180.

However, the latch can be connected to the bracket 130 by any other means, such as welded to the bracket, screwed/bolted onto the bracket, adhered to the bracket, etc., and can constrain the bracket 130 against the pipe adapter 110 and/or the collar 120 in any other suitable way.

8. Arm

Figure 6:
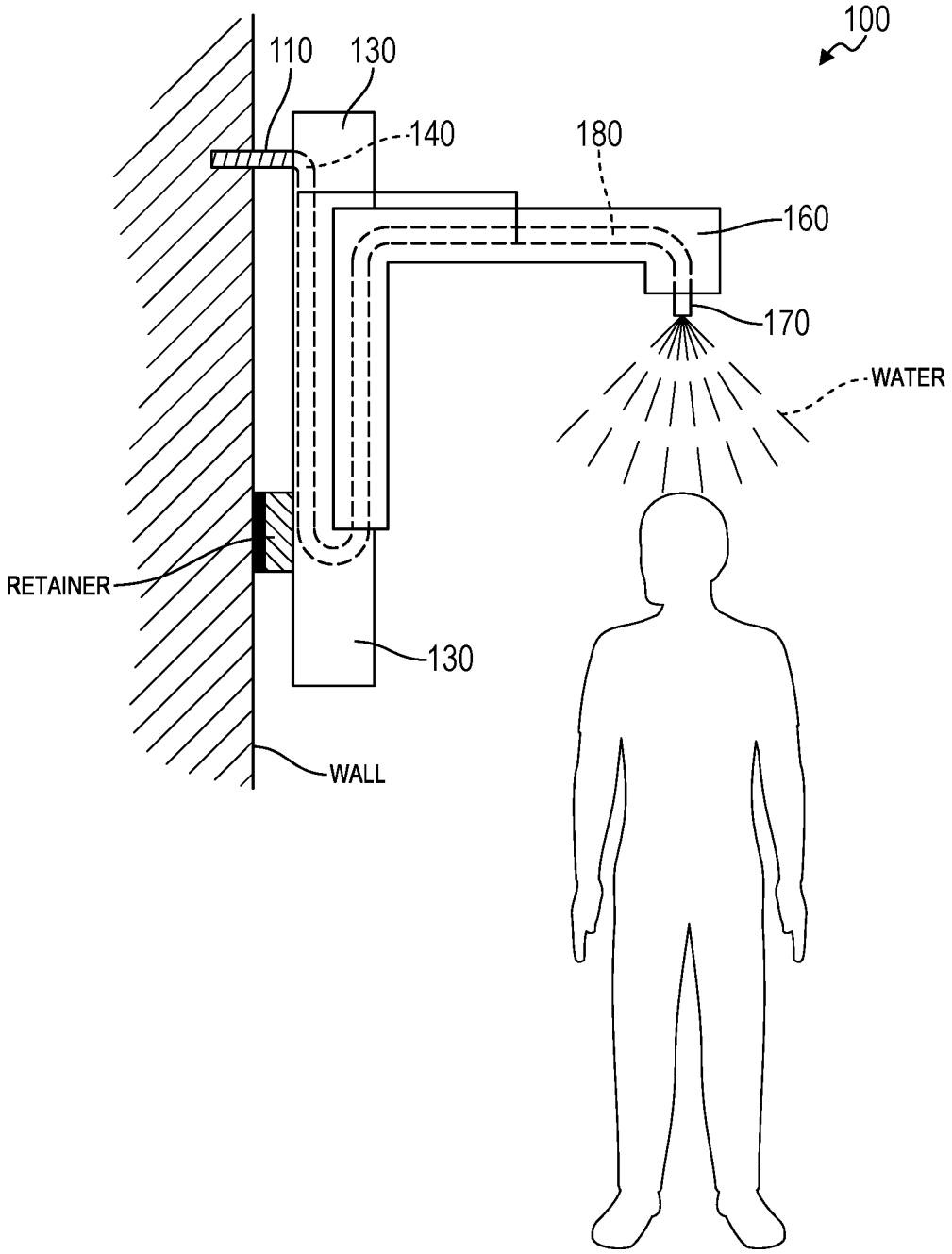
FIG. 6 is a schematic representation of an implementation of the system.

As shown in FIG. 6, the system 100 can include an arm 160 configured to translate linearly along the bracket 130 parallel the longitudinal axis. Generally, the arm 160 functions to translate along the bracket 130 and support the shower head 170 and hoses at various heights within the range of motion of the arm 160.

The arm 160 can be coupled to the bracket 130 and configured to translate along the longitudinal axis of the bracket 130 (e.g., in a vertical direction in a global frame of reference) within a range of motion bounded by an upper stop and a lower stop defined by the bracket (the arm, and/or internal components housed within the arm or the bracket). For example, the bracket 130 can define an upper stop offset above the latch 150 by a first distance (e.g., nine inches) and can define a lower stop offset below the latch 150 by a second distance (e.g., eighteen inches) greater than the first distance. The arm 160 can be configured to translate linearly along the bracket 130 parallel the longitudinal axis of the bracket 130 between the upper stop and the lower stop.

In one implementation, the arm 160 can include a follower, such as an extruded rail extending from the arm 160, configured to engage a track of the bracket 130 according to a free-running (clearance) fit and couple the arm 160 to the bracket 130 to prevent horizontal disassociation of the arm 160 from the bracket. The follower 164 can define any geometry profile, such as a dovetail, rectangular, or v-shaped profile configured to mate with and translate along tracks of the bracket 130 according to the free-running fit, which enables the follower 164 to translate substantially smoothly with minimal interference due to racking.

In another implementation, the arm 160 can define a cantilever segment anchored along the longitudinal axis of the bracket 130 and extending away from the bracket 130 into the bathing environment, as shown in FIGS. 6 and 7. As described below, the arm 160 can support the shower head 170 at the end of the cantilever segment and weight of the shower head 170 (as well as weight of the arm 160 and fluid in hoses supported by the arm 160) can cause the arm 160 to pitch toward the wall, thereby causing engagement features of the arm 160 to rack against the tracks of the bracket.

9. Shower Head

Figure 4:
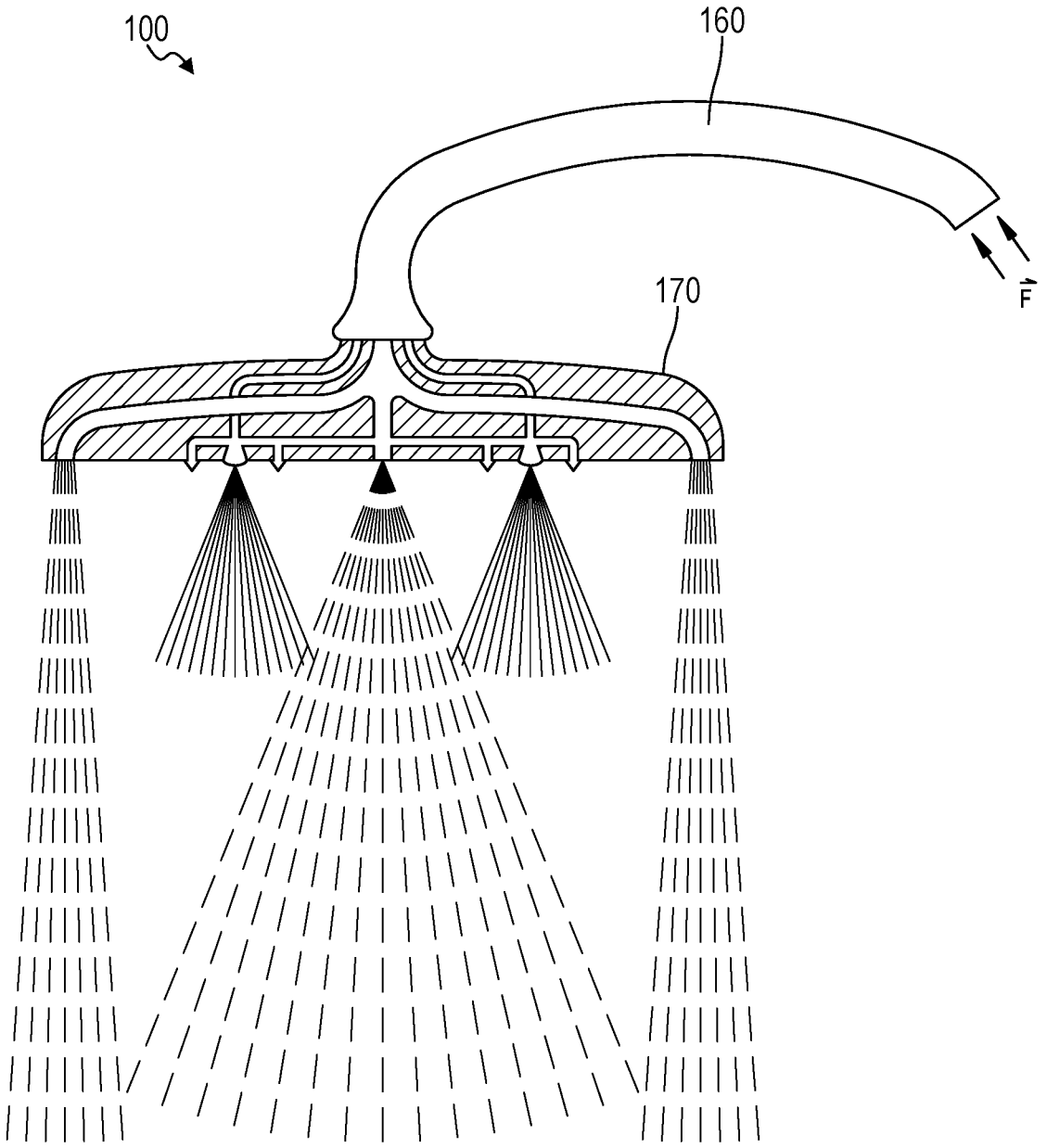
FIG. 4 is a schematic representation of an implementation of the system.

As shown in FIGS. 1A, 1B, and 4, the system 100 can also include a shower head 170 coupled to the arm 160. Generally, the shower head 170 functions to discharge water droplets into the bathing environment surrounding the system, as described in U.S. patent application Ser. No. 15/273,684.

The shower head 170 can couple to an end of the arm (i.e., proximal a distal end of the cantilever segment) opposite the connection between the arm 160 and the bracket 130 such that as the arm 160 travels along the longitudinal axis, the shower head 170 travels accordingly with the arm 160. A hinge, swivel, and/or other static or dynamic fastener can connect the shower head 170 to the arm 160.

As described in U.S. patent application Ser. No. 15/273,684, the shower head 170 can be configured to output a total volume flow rate between 0.6 gallons per minute and 1.25 gallons per minute by discharging water through a set of nozzles integrated into the shower head. A first subset of nozzles (e.g., six nozzles) in the set of nozzles can be arranged in a radial pattern around the shower head. Each nozzle in the first subset of nozzles can be configured to discharge fluid droplets between 350 micrometers and 800 micrometers in width in a spray pattern approximating a sheet (or "flat fan") fanning outwardly and tangent to an arc circumscribing the radial pattern. A second subset of nozzles (e.g., three nozzles) in the set of nozzles can be arranged inside and proximal a center of the radial pattern formed by the first subset of nozzles. Each nozzle in the second subset of nozzles can be configured to discharge fluid droplets between 150 micrometers and 400 micrometers in width in a spray pattern approximating a hollow cone (i.e., a cone fanning outwardly with a void proximal a center of a base of the cone). Additionally, the shower head 170 can include a third subset of nozzles (e.g., one nozzle) arranged inside the radial pattern, each nozzle in the third subset of nozzles configured to discharge fluid droplets between 250 micrometers and 800 micrometers in width in a spray pattern approximating a full cone.

Figure 5A:
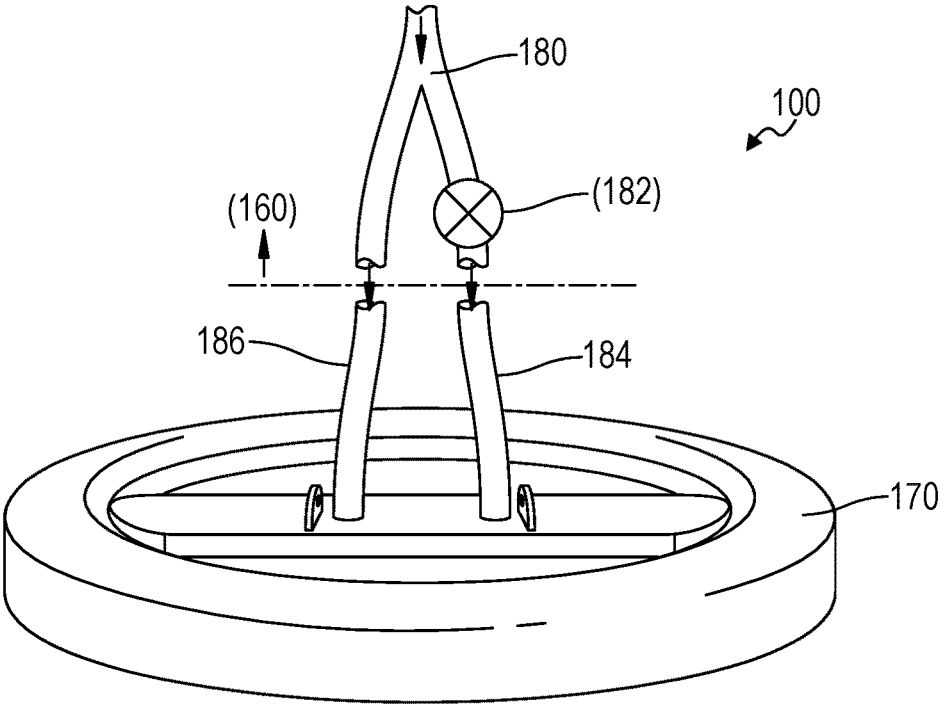
FIGS. 5A and 5B are schematic representations of an implementation of the system.
Figure 5B:
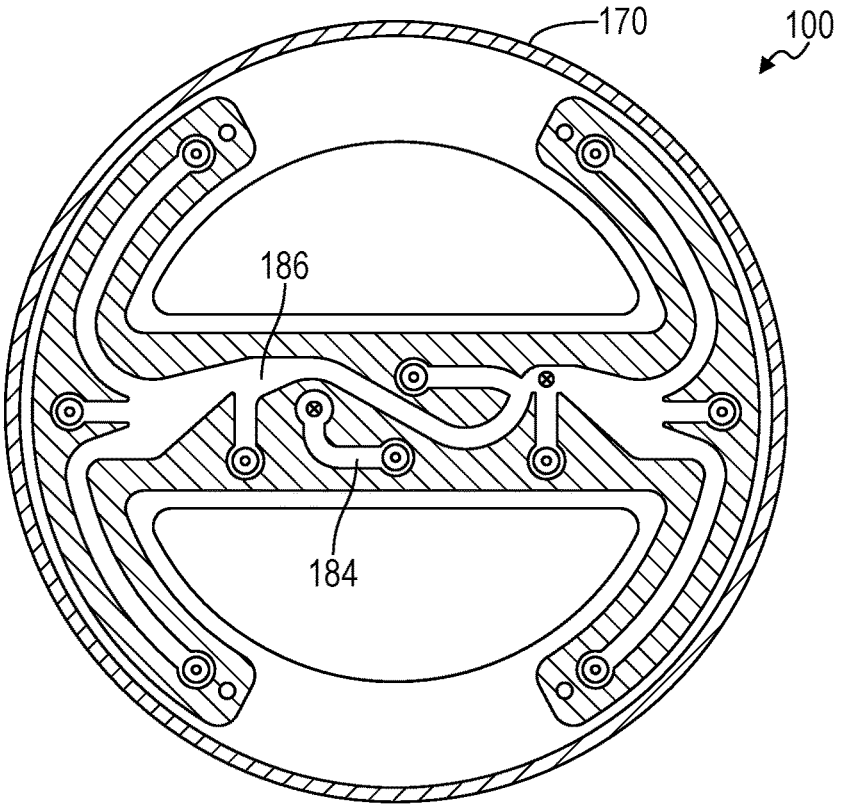

As shown in FIGS. 4, 5A and 5B, the shower head 170 can define multiple fluid circuits configured to direct fluid from the hose 180 to subsets of the set of nozzles. For example, the shower head 170 can include a first fluid circuit 186 (or "fluid pathway") configured to direct fluid from the hose 180 to the first subset of nozzles and the second subset of nozzles; and a second fluid circuit 184 configured to direct fluid from the hose 180 to the third subset of nozzles.

10. Hose

As shown in FIGS. 1A, 1B, and 4, the system 100 includes a hose 180 fluidly coupled to the nipple and to the shower head. Generally, the hose 180 is configured to communicate fluid from the nipple to the shower head.

The hose 180 can include a flexible hollow tube, an array of tubes, a manifold, a hydraulic chamber, a valve, or any combination thereof. The hose 180 can also include a protective sheath, such as a steel-braided housing or other durable enclosure surrounding an internal tube, to resist wear on the hose 180 during translation within the bracket. Alternatively, the hose 180 can be substantially rigid and hollow. For example, the hose 180 can be a manifold or a vessel arranged along an internal surface of the bracket The hose 180 can define a loop housed inside the bracket 130 and can be configured to accommodate of range of positions of the arm 160 relative to the bracket. The hose 180 can define a natural minimum bend radius (i.e., half of a minimum distance between two points on the hose 180 when the hose 180 is bent 180 degrees, thereby forming a U-shape). The minimum bend radius can correspond to internal dimensions of the bracket, such that the hose 180 can both fit within the bracket 130 and cooperate with the bracket 130 to aid translation of the arm 160, as described below. Thus, as the arm 160 translates upward or downward, the hose 180 can shift within the bracket.

As described above, the pipe adapter 110, the collar, the latch 150 and the nipple can function as a manifold mechanically coupling the bracket 130 to the shower wall and serving as a pivot point about which the hose 180 can adjust during translation of the arm 160. A portion of the hose 180 can reside within the bracket 130 and can cooperate with the bracket 130 to retain the arm 160 at a given height in the absence of a force expressly moving the arm 160 from the given height. In the presence of a force displacing the arm 160 upward (e.g., a user pulling the arm 160 upward), the arm 160 can slide upward, moving the shower head 170 upward while maintaining the connection point with the shower wall. A force displacing the arm 160 downward (e.g., a user pushing the arm 160 downward) moves the shower head 170 downward. As the arm 160 moves, a distance between the shower head 170 and the connection of the hose 180 to the pipe adapter 110 changes. To accommodate a change in distance between a connection between the hose 180 and the nipple and a connection between the hose 180 and the shower head, a portion of the hose 180 shifts upward or downward with the arm 160 while a remaining portion of the hose 180 remains constrained against the arm 160.

11. Other Hydraulic Components

In one variation, the system can also include a pressure regulator 142 interposed between the nipple and the hose 180 and configured to limit a maximum pressure of fluid communicated from the water supply to the shower head. Generally, the pressure regulator 142 functions to control droplet sizes and velocities of droplets output from the shower head. In this variation, the maximum pressure defined by the pressure regulator 142 can correspond to a target droplet size of approximately 550 micrometers discharged by the first subset of nozzles described above and approximately 200 micrometers discharged by the second subset of nozzles described above.

In another variation shown in FIGS. 5A and 5B, the system can include a second hose configured to communicate fluid from the hose 180 to the first fluid circuit 186 and a third hose configured to communicate fluid to the second fluid circuit 184. The system can also include a switch mounted to the arm 160 and configured to selectively communicate fluid from the hose 180 to the third hose when the switch 182 is in an open position and restrict flow of fluid to the third hose when the switch 182 is in a closed position. In this variation, the hose 180 can fluidly couple to an outlet of the pressure regulator 142 and terminate at the switch 182 and an inlet to the second hose. The switch 182 can function to selectively enable and disable discharge of water droplets from the third subset of nozzles.

12. Spring

As shown in FIGS. 7 and 9, the system can include a spring 190 configured to apply a force on the arm 160 against the bracket 130 to counter weight of the arm 160, the shower head, and fluid contained in the hose 180. Generally, the spring functions to counterbalance the weight of the arm 160, the shower head, and fluid contained in the hose 180 such that, in the absence of an input by a user displacing the arm 160 from a particular position, the arm 160 remains in the particular position.

In particular, the system can include a counterweighting element, such as a spring and/or damper system, configured to apply a force to bias the arm 160 upwardly against the bracket 130. In particular, the spring can apply a force to the arm 160—to lift the arm 160 above the bracket—approximately equivalent to the weight of the arm 160, the shower head 170, and water contained in fluid circuitry within the arm 160 and the shower head 170. Therefore, the spring can be interposed between the arm 160 and the bracket to assist motion of the arm 160 relative to the bracket and can function to balance the weight of the arm 160 and the shower head 170 against the bracket 130, thereby retaining the arm 160 and the shower head 170 in a static position until a user applies a vertical force to the arm 160 or the shower head 170 to raise or lower the arm 160 on the bracket 130.

In one implementation, the spring defines a mainspring wound around a spool. For example, the bracket 130 can support the spool, and the spool can be configured to spin freely within the bracket 130. A first end of the spring can be wound around the spool, and a second end of the spring opposite the spool can be fastened to the arm 160, such as proximal a bottom of the arm 160. As described above and shown in FIGS. 7 and 9, the bracket 130 can define one or more tracks extending within a plane parallel to the longitudinal axis and the arm 160 can define a follower configured to engage the track 134 according to a free-running fit. In this implementation, the spring can couple to the arm 160 offset from the plane such that an axis along which the spring pulls the arm 160 is skew to the axis of travel of the arm 160, thereby counteracting racking of the arm 160 against the bracket 130 (e.g., racking of followers on the arm 160 within tracks in the bracket 130) due to a moment directed downward and generated by cantilevered weight of the cantilevered section of the arm 160 and the shower head.

The spring can be a mainspring (e.g., a "constant force" spring), which supplies an approximately consistent force across the length of the spring as the spring unwinds from a spool. A mainspring exerts a force on an object coupled to an end of the mainspring, the force proportional to a torque necessary to unwind the mainspring from the spool. In this example, one end of the mainspring can be coupled to the arm 160, while a spool around which the mainspring can unwind can be coupled to the bracket. The mainspring can be tuned to apply a force on the bracket 130 that counteracts a force due to gravity and the rolling and peeling friction applied by the hose 180 on the bracket 130 and the arm 160 guide. Thus, the mainspring functions to resist motion (e.g., slippage) downward due to gravity in the absence of an input applied by the user to move the arm 160 upward or downward and limit an input force needed to translate the arm 160 along the bracket. In the absence of an input force displacing the arm 160 from a position, the mainspring and hose can retain the arm 160 in the position by counteracting the force due to gravity (i.e., that which pulls the arm 160 downward from the position).

Alternatively, the spring can be a constant torque spring, which supplies a substantially consistent torque across the length of the spring as the spring unwinds. In this implementation, the arm 160 can travel continuously along the bracket 130 to any point within the range of motion of the bracket.

However, the spring and/or damper system can counter weight of the arm 160, shower head, fluid in the hoses, and any other internal components supported by the arm 160 in any other way to aid translation of the arm 160 along the bracket 130 in response to an input and resist translation of the arm 160 along the bracket 130 in the absence of an input.

13. Hose-Assisted Arm Translation

In one variation shown in FIG. 8, the hose 180 and the bracket 130 can cooperate with the arm 160 to resist translation of the arm 160 in the absence of an input force applied by the user. In this variation, the hose 180 functions to dampen motion of the arm 160 relative to the bracket 130 in the absence of an input. The hose 180 can include a tube of a particular minimum bend radius proportional to half of a width of the bracket. Thus, the tube can form a "U-shape" within the bracket. A downstroke portion of the "U-shape" extends from the nipple down to a bend of the "U-shape". A guide attached to the arm 160 can guide the upstroke of the "U-shape" of the tube, extending from the bend of the "U-shape" up and out of the bracket 130 onto the arm 160. An end of the tube extends out of the bracket 130 onto the arm 160, such that an outlet of the hose 180 corresponds with and is constrained near the termination of the arm 160 proximal the shower head. The upstroke and the downstroke of the tube are constrained substantially parallel to each other within the bracket 130. Thus, as the arm 160 moves upward, the downstroke peels off the shower wall of the bracket 130 while the bend of the "U-shape" rolls onto the guide attached to the arm 160. Thus, the upstroke gets longer as the downstroke of the tube gets short. Peeling and rolling friction applied by the tube on the bracket 130 and guide maintains the arm 160 at a particular location in the absence of a force to overcome both the peeling and the rolling friction. Likewise, as the arm 160 moves downward, the bend of the "U-shape" rolls onto the side of the bracket 130 while the upstroke peels off of the arm 160 guide. Thus, the downstroke of the tube lengthens as the upstroke shortens. In this variation, the bracket 130 can include a track out of which the tube can connect to the arm 160.

14. Shower Wand

In one variation shown in FIGS. 1A and 1B, the system can also include a shower wand 195 configured to discharge fluid through a fourth subset of nozzles; and a wand hose fluidly coupled to a second outlet of the pressure regulator 142, enclosed by the bracket 130 adjacent the hose 180, and configured to communicate fluid from the pressure regulator 142 to the shower wand 195. In this variation, generally, the shower wand 195 functions as an accessory outlet for discharging water droplets. The shower wand 195 can include a first wand hose, external to the bracket, coupled to a wand fluid circuit integrated into the shower wand 195 and communicating fluid to the subset of nozzles in the wand. A second wand hose 196 can couple to an outlet of the pressure regulator 142 (and/or directly to the nipple) and can route through the bracket 130 adjacent the hose 180 feeding fluid to the shower head. The second wand hose can terminate at an inlet to the first wand hose proximal a bottom of the bracket 130 and, therefore, communicate fluid from the pressure regulator 142 to the first wand hose. As the arm 160 translates upward and downward and the hose 180 looped inside the bracket 130 shifts according to translation of the arm 160, the first wand hose remains stationary adjacent the spring and the hose 180.

15. Retainer

In another variation, the system can also include a retainer which couples to the bracket 130 and serves to retain a portion of the bracket 130 against the external surface of the shower wall and limit rotation of the bracket 130 about the pipe adapter 110 and the rotational axis of the pipe adapter 110, as described above. The retainer 132 includes features that can mate with features built into a back surface of the bracket. For example, the retainer 132 can be a flexure that can snap into an opening in the bracket, thereby retaining the bracket 130 against the retainer 132. A surface of the retainer 132 opposite the bracket 130 can include an adhesive layer that can adhere to the shower wall. Therefore, the retainer 132 can constrain a lower portion of the bracket 130 against the shower wall. Additionally, the flexure can be released from the bracket 130 by depressing the flexure away from the opening and releasing the snap. Alternatively, the retainer 132 can be an adhesive sheet that adheres a lower portion of the bracket 130 directly to the shower wall.

However, the retainer can couple to the bracket 130 in any other way (e.g., magnetically) and can retain the bracket 130 against the external surface of the shower wall permanently or transiently by any other means.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

We claim:

1. A system comprising:

a pipe adapter defining an inlet configured to thread into a water supply outlet adjacent a shower wall, defining an external threaded section opposite the inlet, and defining an internal bore between the inlet and the external threaded section;

a bracket defining an opening;

a shower head coupled to the bracket and offset from the opening;

a collar fluidly decoupled from water flowing through the pipe adapter and defining:

a surface configured to face the shower wall;

a retention feature offset from the surface configured to insert into the opening; and an internal threaded section defining a rotational axis normal the surface, the internal threaded section configured to thread over the external threaded section of the pipe adapter and to tension the pipe adapter between the water supply outlet and the shower wall;

a nipple coupled to the bracket, flexibly located within the opening of the bracket, configured to insert into the pipe adapter, comprising a seal configured to mate with the internal bore of the pipe adapter, retained in the pipe adapter by the bracket, and fluidly coupled to the shower head; and a latch coupled to the bracket and configured to transiently engage the retention feature to constrain the bracket against the collar and to retain the nipple inside the pipe adapter.

2. The system of claim 1, wherein the collar is configured to tension the pipe adapter against the water supply outlet, to support the bracket against vertical and pitch displacement when the surface is abutted with the shower wall, and to permit rotation of the bracket about the rotational axis.

3. The system of claim 1:

wherein the pipe adapter defines the external threaded section over a first range of distances from the inlet;

further comprising a second pipe adapter interchangeable with the pipe adapter, defining a second inlet configured to thread into the water supply outlet adjacent the shower wall, defining a second external threaded section over a second range of distances from the second inlet different from the first range of distances, and defining a second internal bore between the second inlet and the second external threaded section; and wherein the pipe adapter and the second pipe adapter are interchangeable and selectable to position threads of one of the external threaded section and the second external threaded section coincident a plane of the shower wall.

4. The system of claim 1, wherein the shower head outputs a total volume flow rate between 0.6 gallons per minute and 1.25 gallons per minute.

5. The system of claim 1, wherein the shower head comprises:

a first subset of nozzles arranged in a radial pattern, each nozzle in the first subset of nozzles configured to discharge fluid droplets in a spray pattern approximating a sheet fanning outwardly and tangent to an arc circumscribing the radial pattern;

a second subset of nozzles arranged inside the radial pattern, each nozzle in the second subset of nozzles configured to discharge fluid droplets in a spray pattern approximating a hollow cone; and a third subset of nozzles arranged inside the radial pattern, each nozzle in the third subset of nozzles configured to discharge fluid droplets in a spray pattern approximating a full cone.

6. The system of claim 5:

wherein each nozzle in the first subset of nozzles is configured to discharge fluid droplets between 350 micrometers and Boo micrometers in width;

wherein each nozzle in the second subset of nozzles is configured to discharge fluid droplets between 150 micrometers and 400 micrometers in width; and wherein each nozzle in the third subset of nozzles is configured to discharge fluid droplets between 250 micrometers and Boo micrometers in width.

7. The system of claim 6, further comprising a pressure regulator interposed between the nipple and the hose and configured to limit a maximum pressure of fluid communicated from the water supply to the shower head, the maximum pressure corresponding to a target droplet size of approximately 550 micrometers discharged by the first subset of nozzles and approximately 200 micrometers discharged by the second subset of nozzles.

8. The system of claim 7, further comprising:

a shower wand configured to discharge fluid through a fourth subset of nozzles; and a wand hose fluidly coupled to the pressure regulator, enclosed by the bracket adjacent the spring, and configured to communicate fluid from the pressure regulator to the shower wand.

9. The system of claim 5:

wherein the shower head defines:

a first fluid circuit configured to direct fluid to the first subset of nozzles and the second subset of nozzles; and a second fluid circuit configured to direct fluid to the third subset of nozzles; and further comprising:

a second hose defining an inlet tapped into the hose and an outlet fluidly coupled to the first fluid circuit;

a third hose fluidly coupled to the second fluid circuit; and a switch mounted to the arm, interposed between an outlet of the hose and an inlet of the third hose, configured to communicate fluid from the hose to the third hose in an open position, and configured to restrict flow of fluid from the hose to the third hose in a closed position.

10. The system of claim 1:

wherein the collar defines a tapered section extending away from the surface and defines the retention feature comprising a groove between the surface and the tapered section; and wherein the latch comprises:

a retention plate coupled to the bracket and configured to ride up the tapered section during installation of the shower system onto the collar; and a spring configured to drive the retention plate into the groove to lock the bracket onto the collar.

11. The system of claim 1, further comprising:

an arm configured to translate linearly along the bracket parallel the longitudinal axis;

a shower head coupled to the arm;

a hose fluidly coupled to the nipple and to the shower head; and a spring configured to apply a force on the arm against the bracket to counter weight the arm, the shower head, and fluid contained in the hose.

12. The system of claim 11, wherein the hose defines a loop housed inside the bracket and is configured to accommodate of range of positions of the arm relative to the bracket.

13. The system of claim 11:

wherein the bracket defines a track extending within a plane parallel to the longitudinal axis;

wherein the arm comprises a follower configured to engage the track according to a free-running fit; and wherein the spring is coupled to the arm offset from the plane.

14. A system comprising:

a pipe adapter defining an inlet configured to thread into a water supply out let adjacent a shower wall, defining an external threaded section opposite the inlet, and defining an internal bore between the inlet and the external threaded section;

a bracket defining an opening;

a shower head coupled to the bracket and offset from the opening;

a collar configured to insert into the opening, fluidly decoupled from water flowing through the pipe adapter, and defining:

a surface configured to face the shower wall;

a retention feature offset from the surface; and an internal threaded section defining a rotational axis normal the surface, configured to thread over the external threaded section of the pipe adapter, and configured to tension the pipe adapter between the water supply outlet and the shower wall;

a nipple:

configured to be driven into the internal bore of the pipe adapter by the bracket;

fluidly coupled to the shower head; and comprising a seal configured to mate with the internal bore; and a latch coupled to the bracket and configured to transiently engage the retention feature to constrain the bracket against the collar and to retain the nipple inside the pipe adapter.

15. The system of claim 14:

further comprising a second pipe adapter interchangeable with the pipe adapter, defining a second inlet configured to thread into the water supply outlet adjacent the shower wall, defining a second external threaded section over a second range of distances from the second inlet different from the first range of distances, and defining a second internal bore between the second inlet and the second external threaded section; and wherein the pipe adapter and the second pipe adapter are interchangeable and selectable to position threads of one of the external threaded section and the second external threaded section coincident a plane of the shower wall.

16. The system of claim 15:

wherein the pipe adapter and the second pipe adapter are selectable to position threads of one of the external threaded section and the second external threaded section aligned with a first surface of the shower wall proud of and offset from a second surface of the shower wall, the pipe adapter traversing the second surface through an opening in the shower wall, the opening coincident the second surface and vertically offset above the first surface; and further comprising a spacer configured to mount concentrically over an external surface of the pipe adapter between the surface of the collar and the second surface of the shower wall, a first face of the spacer abutted with the second surface of the shower wall and a second face of the spacer interfacing with the surface of the collar.

17. The system of claim 14:

further comprising:

a bracket defining an opening configured to accept the collar and extending along a longitudinal axis;

an arm configured to translate linearly along the bracket parallel the longitudinal axis; and a mainspring configured to apply a force on the arm against the bracket to counter weight the arm and the shower system, and fluid contained in the shower system;

wherein the nipple is flexibly coupled to the bracket and is configured to reposition into concentricity with the internal bore during insertion into the internal bore;

wherein the latch is configured to retain the nipple inside the pipe adapter; and wherein the shower system is coupled to the arm and comprises:

a first subset of nozzles configured to discharge fluid droplets of a first diameter in spray patterns; and a second subset of nozzles configured to discharge fluid droplets of a second diameter greater than the first diameter.

18. The system of claim 17, wherein the bracket comprises an upper stop offset above the rotational axis by a first distance and a lower stop offset below the rotational axis by a second distance greater than the first distance; and wherein the arm is configured to translate linearly along the bracket parallel the longitudinal axis between the upper stop and the lower stop.

19. The system of claim 14:

wherein the collar defines a tapered section extending away from the surface and defines the retention feature comprising a groove between the surface and the tapered section;

wherein the latch comprises:

a retention plate coupled to the bracket and configured to ride up the tapered section during installation of the shower system onto the collar; and a spring configured to drive the retention plate into the groove to lock the shower system onto the collar.

20. The system of claim 14, wherein the collar is configured to tension the pipe adapter against the water supply outlet, to support the bracket against vertical and pitch displacement when the surface is abutted with the shower wall, and to permit rotation of the bracket about the rotational axis.

* * * * *